US005413089A

United States Patent [19]

Andors et al.

[11] Patent Number: 5,413,089

[45] Date of Patent: May 9, 1995

[54] WOOD AND COAL BURNING STOVE

[75] Inventors: Derik K. Andors, Randolph; Robert W. Ferguson, South Royalton, both of Vt.; Dane P. Harman, Halifax, Pa.

[73] Assignee: Harman Stove and Welding, Inc., Halifax, Pa.

[21] Appl. No.: 26,434

[22] Filed: Mar. 4, 1993

[51] Int. Cl.[6] ..... F24C 1/14

[52] U.S. Cl. ..... 126/77; 126/80; 126/15 R; 110/210

[58] Field of Search ..... 126/77, 15 R, 80, 245; 110/203, 205, 210, 211, 214

[56] References Cited

U.S. PATENT DOCUMENTS

| | | | |
|---|---|---|---|
| 4,249,509 | 2/1981 | Syme | 126/77 |
| 4,380,228 | 4/1983 | Crowley | 126/76 |
| 4,487,195 | 12/1984 | Syme et al. | 126/77 |
| 4,582,044 | 4/1986 | Ferguson et al. | 126/83 |
| 4,646,712 | 3/1987 | Ferguson et al. | 126/77 |
| 4,672,946 | 6/1987 | Craver | 126/83 |
| 4,683,868 | 8/1987 | Ferguson et al. | 126/83 |
| 4,708,123 | 11/1987 | Strnad | 126/83 |
| 4,856,491 | 8/1989 | Ferguson et al. | 126/77 |
| 5,113,843 | 5/1992 | Henry et al. | 126/77 |
| 5,139,008 | 8/1992 | Timpano | 126/77 |

*Primary Examiner*—Larry Jones
*Attorney, Agent, or Firm*—Thomas Hooker

[57] ABSTRACT

A solid fuel burning stove includes a firebox having front side and rear walls, a top and a bottom, and a secondary combustion unit formed from high temperature insulative refractive material mounted on the top and rear wall of the firebox. The unit is connected to the firebox by a mouth located in the rear wall adjacent the floor of the firebox and by a perforated plate on the firebox top wall. A vertical combustion passage extends from the mouth up to a mixing and combustion chamber located in the unit above the top wall of the firebox. The secondary combustion unit efficiently burns secondary combustion gases flowing into the unit through the mouth and plate during different stages of burning solid fuel, particularly wood.

56 Claims, 12 Drawing Sheets

WOOD AND COAL BURNING STOVE

FIELD OF THE INVENTION

The invention relates to solid fuel burning stoves and, more particularly, wood and coal fired stoves used for home heating.

DESCRIPTION OF THE PRIOR ART

Wood and coal fired home heating stoves have been used since as early as the 18th century. Early stoves included a metal firebox with a flue pipe extending from the firebox through a wall of the building to the exterior. Combustion air flows into the firebox to support combustion. All of the gases generated during combustion, including all pollutants, flow out of the firebox, through the flue and are vented to atmosphere. Early home heating stoves had no provision for controlling pollution. Frequently, when the stoves burned wood at low rates, volatilized material would condense on and build up in the flue pipe as creosote or wood escape to the atmosphere as gaseous and particulate emissions. These stoves not only pollute the atmosphere but also are likely to cause chimney fires.

Two approaches have been used to remove pollutants from wood burning stove combustion gases. One approach involves mounting a catalyst element, similar to a conventional automobile exhaust catalyst element, in the combustion gas exhaust passage. The catalyst enables pollutants to be burned at the low temperature of combustion gases flowing from the stove. In conventional catalyzed heating stoves, low temperature combustion gases carrying pollutants are flowed past the catalyst and pollutants are burned. The catalyst promotes mixing of the flue gases and stimulates combustion. Typically, the entire exhaust stream is flowed through a catalyst in order to reduce pollutants and generate an exhaust flow cleaner than the exhaust flow from a non-catalyzed wood-burning stove.

Catalytic elements used in wood burning stoves are expensive and subject to periodic replacement and the attendant cost. Additionally, catalyzed stoves cannot be used for burning coal because elements in coal exhaust gases, typically sulphur and chlorine, poison the catalyst in the catalytic element rendering it inoperable.

Efforts have been made to make non-polluting, non-catalytic wood-burning stoves. Typically, in these stoves a secondary combustion chamber is provided and maintained at a temperature sufficiently high to burn pollutants in the exhaust stream. Most commonly, the secondary combustion area is located above a baffle in the top of the firebox. This area is well insulated. Secondary air is flowed into the chamber. All of the combustion gas is flowed through the secondary combustion chamber and exits up the flue pipe. In theory, the secondary combustion chamber is maintained at a high temperature sufficient to burn pollutants in the stream passing through the chamber. In practice, it is very difficult to maintain the temperature in the secondary combustion chamber sufficiently high during the entire burning cycle to assure clean burning.

At the end of the burn cycle when primarily charcoal is remaining, almost no particulate pollutants are being formed. Most emissions occur during the beginning and middle of the burn cycle. Non-catalytic stoves commonly must be operated at higher burn rates in order to ensure that the elevated temperatures required to sustain secondary combustion are obtained.

Further efforts to improve the reduction of pollutants in the exhaust stream have focused on insulating the firebox and thereby increasing the temperature of combustion in the firebox and the temperature in the secondary combustion chamber, in order to assure that pollutants are burned throughout the burning cycle. As a result, it is difficult to draw heat from the insulating fireboxes, thereby decreasing the home heating efficiency of the stove. A large portion of the heat generated in the firebox flows through the secondary combustion chamber and out the chimney.

The heavily insulated fireboxes have flat floors which support the fuel. While these types of floors may be used effectively to support burning wood, it is not possible to burn coal on a flat floor. Burning of coal requires flowing the primary combustion air up through the body of the coal or a stoker. Insulated wood burning stoves cannot easily be converted to burn coal.

The federal Environmental Protection Agency has established stringent pollution requirements for wood-fired heating stoves. In order to meet these requirements, the stove must burn very nearly all volatilized pollutants generated during the entire combustion cycle, including the initial heating cycle when wood freshly placed in the firebox is warmed to a combustion temperature, the main burn portion of the cycle when the wood is burned and the burn down or end of the cycle when the wood has been reduced to charcoal and ash. Conventional wood fired heating stoves are unable to meet these very stringent anti-pollution standards.

SUMMARY OF THE INVENTION

The invention is a stove of the type used for home heating capable of burning wood cleanly within current federal EPA standards. The stove is easily converted to burning coal.

The stove includes a secondary combustion unit mounted on the back in the top of the stove firebox. This unit is connected to the firebox by a mouth located low in the rear wall of the firebox and by a perforated plate located in the top wall of the firebox adjacent the rear wall. A flow passage in the secondary combustion unit extends up from the mouth to the perforated wall and divided U-shaped flow paths extend from the plate to a pair of spaced outlets formed in the top of the unit above the firebox. The unit is made from high temperature insulative refractory materials in order to maintain and withstand the high combustion temperatures during secondary combustion of pollutants in the exhaust stream. The combustion gases generated by burning wood in the firebox flow into the secondary combustion unit through the lower mouth and through the upper perforated plate in different proportions during the different stages of combustion. During the initial stage, fresh wood is reloaded on the charcoal bed remaining from the previous fuel load. While the fresh wood is heated to a temperature sufficient to sustain combustion, gases from the charcoal bed are flowed into the secondary combustion unit through the lower mouth and provide a high temperature gas stream at sufficiently elevated temperature to cause ignition of the cooler gases flowing from the wood being heated in the firebox. These cooler gases flow through the perforated plate the top of the firebox and reflow into the secondary combustion unit. The cooler gases mix with the high temperature gas stream from the charcoal bed and the combined flow from both inlets is further burned as it is divided and passes through the U-shaped flow paths before exiting from the secondary combustion unit.

During burning of the wood in the firebox, the generated combustion gases flow into the secondary combustion unit through both the mouth at the bottom of the rear wall and through the perforated plate. These gases may be sufficiently hot to ignite jets of secondary combustion air flowed into the gases immediately below the perforated plate. The jets initiate combustion of pollutants and additionally form an aesthetically pleasing display which may be viewed through the glass pane at the front of the stove.

A very small quantity of under grate air keeps the charcoal bed active. The air entering at the lower mouth of the combustion chamber helps stimulate higher ignition temperatures by burning charcoal at the ignitor passage inlet mouth.

The stove supports fuel on a grate at the bottom of the firebox. During burning of wood in the stove, the primary combustion air is flowed down the front of the firebox and across the wood. The stove is easily converted to burning coal by shifting a valve in the combustion air flow system to flow the primary combustion air up through the bottom of a pile of coal supported by the grate. When burning coal it may be desirable to open a stove bypass damper at the top of the firebox in order to flow combustion gases directly from the stove.

Other objects and features of the invention will become apparent as the description proceeds, especially when taken in conjunction with the accompanying drawings illustrating the invention, of which there are 12 sheets and one embodiment.

DESCRIPTION OF THE PREFERRED EMBODIMENT

Figure 1:
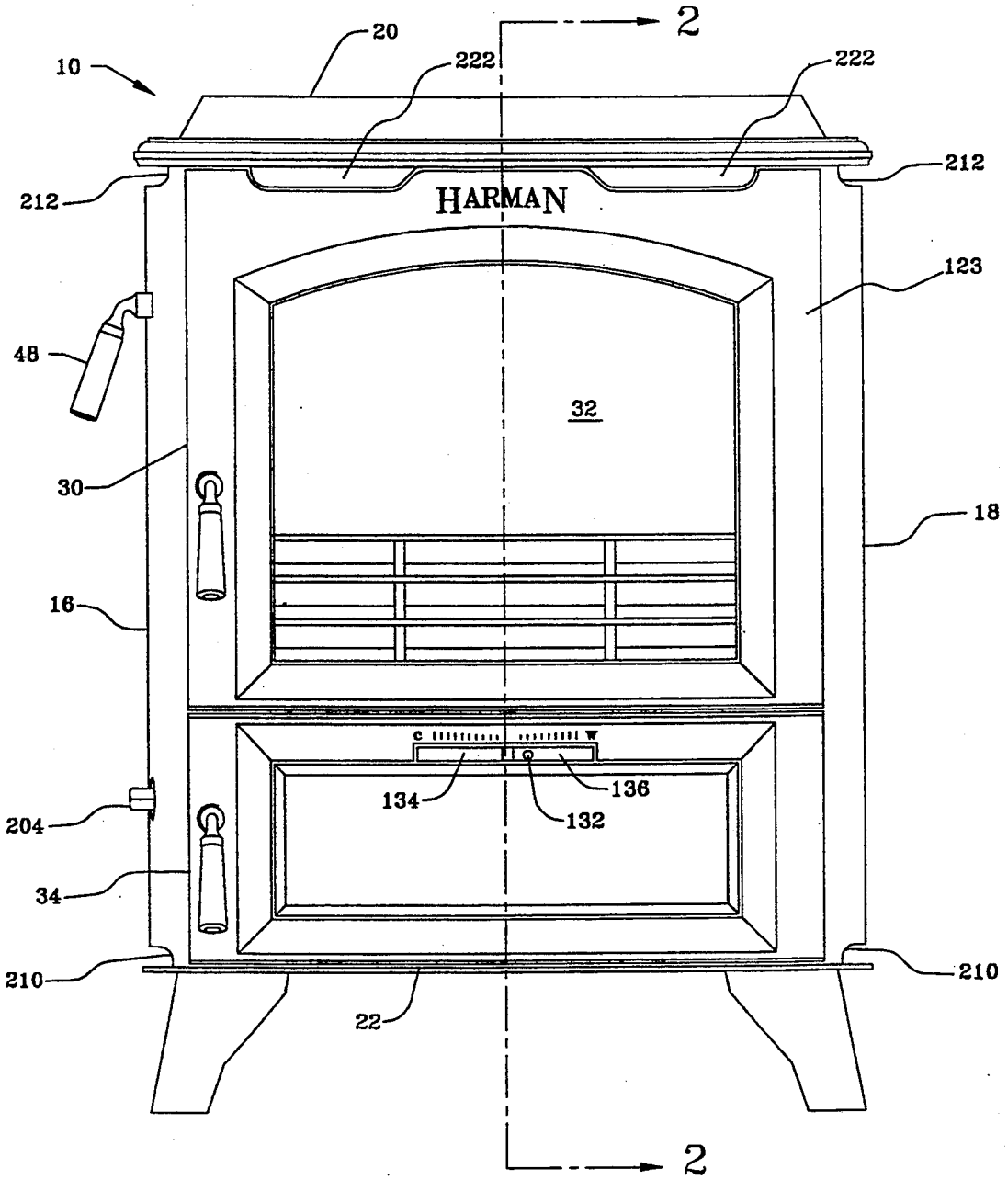
FIG. 1 is a front view of a stove according to the invention.

Wood and coal burning stove 10 has a generally rectangular shape including a vertical front wall 12, vertical rear wall 14 and vertical side walls 16 and 18, horizontal top 20 and bottom 22. A central firebox or primary combustion chamber 24 is located within the center of the stove and faces front wall 12. A grate 26 extends across and defines the bottom of the firebox. Grate 26 separates the firebox from an ash pit 28 in the bottom of the stove.

An upper access door 30 is provided in the front wall 12 to provide access to the firebox. The door includes a transparent double pane glass panel 32 which permits visual inspection of combustion in the firebox. A lower ash removal door 34 is mounted on the front wall below door 30 and may be opened to remove ashes from ash pit 28 as required. If desired, an ash pan may be fitted in pit 28 to facilitate collection and removal of ashes. The doors 30 and 34 are mounted on the front wall by conventional hinges and latches.

Figure 2:
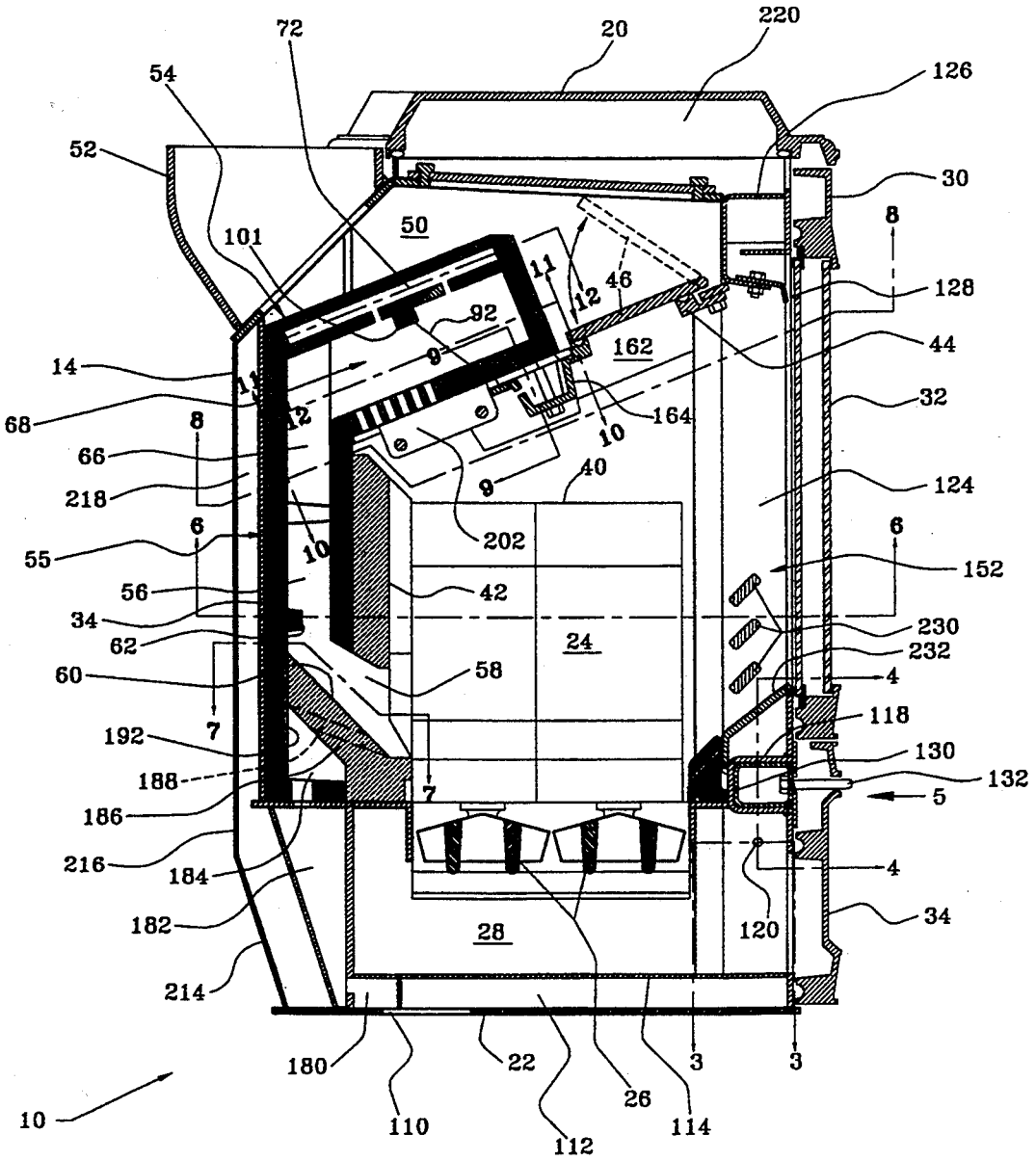
FIG. 2 is a sectional view taken along line 2—2 of FIG. 1.
Figure 3:
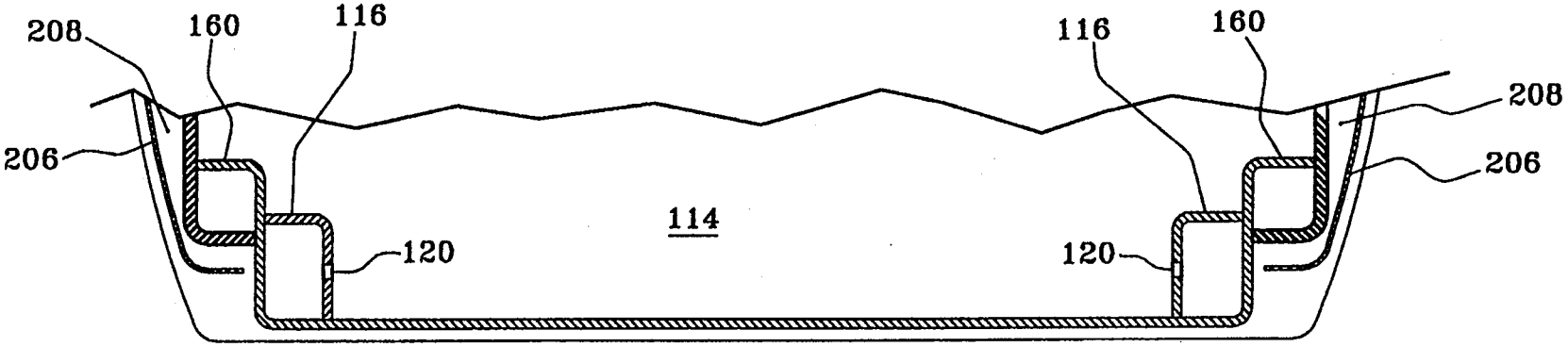
FIGS. 3 through 12 are sectional views taken, respectively, along lines 3—3 through 12—12 of FIG. 2.
Figure 8:
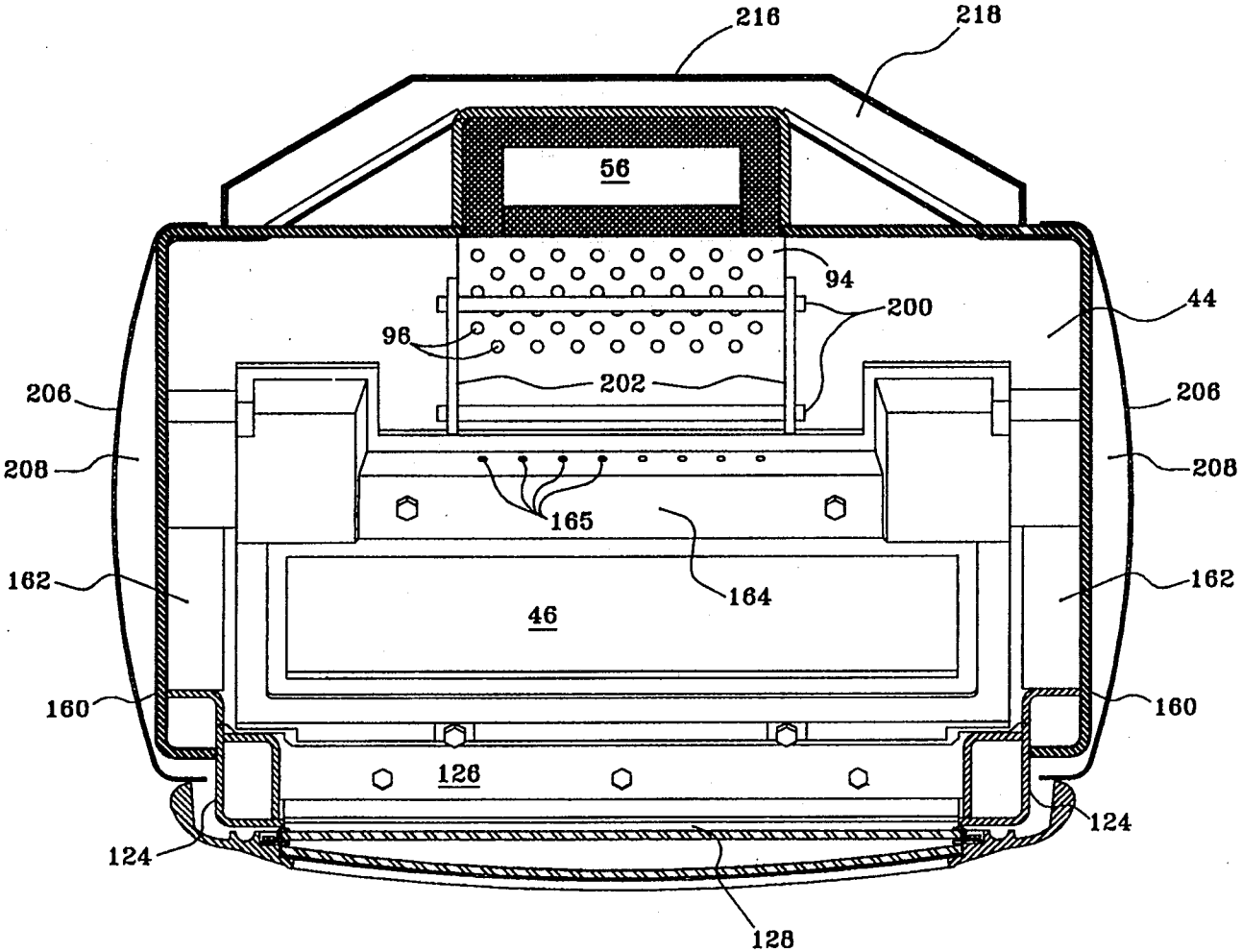

A refractory lining 36 is provided on the lower side walls 38 and 40 and back wall 42 of firebox 24. Top wall 44 extends from the front of the stove adjacent the top of panel 32 down at an angle of about 20 degrees and joins the top of the back wall 42 a distance below the top of the viewing panel 32 so that the top wall of the firebox is visible through the panel. As illustrated in FIGS. 2 and 8, a bypass damper 46 is provided in top wall 44 adjacent the front of the stove and may be moved between the closed solid line and open dotted line positions as illustrated by actuation of damper handle 48 shown in FIG. 1. When the damper is open, as shown in dotted lines, the top of the primary combustion chamber 24 is open to collection chamber 50 in the top of the stove. Flue outlet 52 is mounted on the upper rear corner of the stove in communication with chamber 50 and is connected to a conventional flue pipe (not illustrated).

Stove 10 includes a split flow path secondary combustion unit 54 for completely burning the combustible components of gases generated by primary combustion of solid fuel, typically wood, burned in firebox 24. As shown in FIG. 2, unit 54 is mounted on the back wall 42 of the firebox and on the lower portion of the top wall 44. Unit 54 is formed from suitable high temperature insulative refractory material capable of maintaining and withstanding the very high temperatures resulting from secondary combustion of volatile gases generated during burning of fuel in firebox 24.

The secondary combustion unit 54 includes a lower portion 55 defining a rectangular vertical combustion passage 56 mounted on the firebox back wall 42 and extending upwardly along the wall from a lower mouth 58 opening into the firebox on the back wall adjacent and a short distance above the grate 26. The lower surface 60 of mouth 58 slopes downwardly into the firebox at an angle of approximately 45 degrees to prevent the collection of ashes or charcoal in the mouth sufficient to severely restrict or clog the mouth and prevent combustion gases from flowing through the mouth and into the combustion unit. Three spaced mixing ribs 62 project inwardly from the rear refractory wall 64 of passage 56 a short distance above mouth 58.

Figure 10:
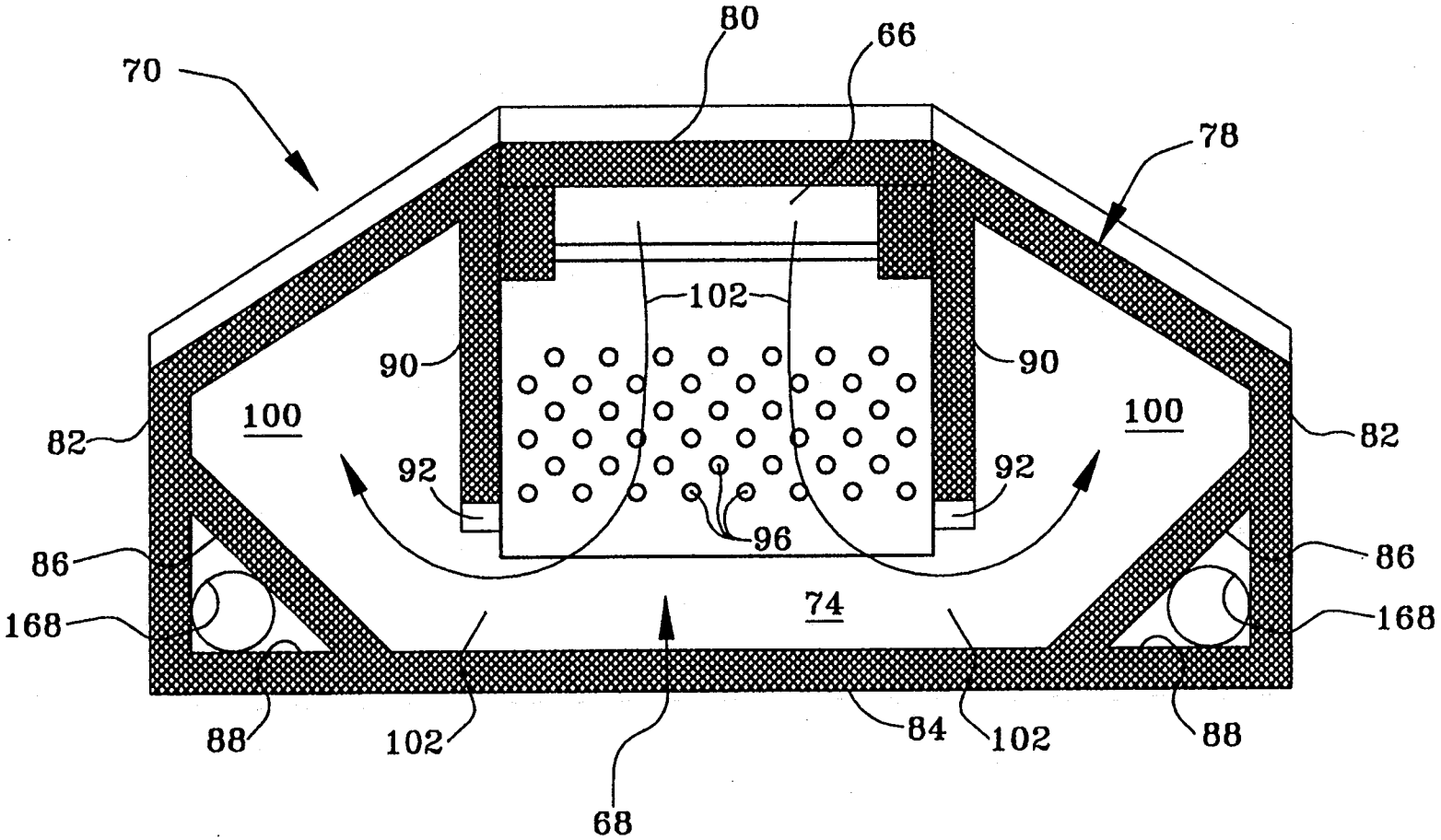
Figure 11:
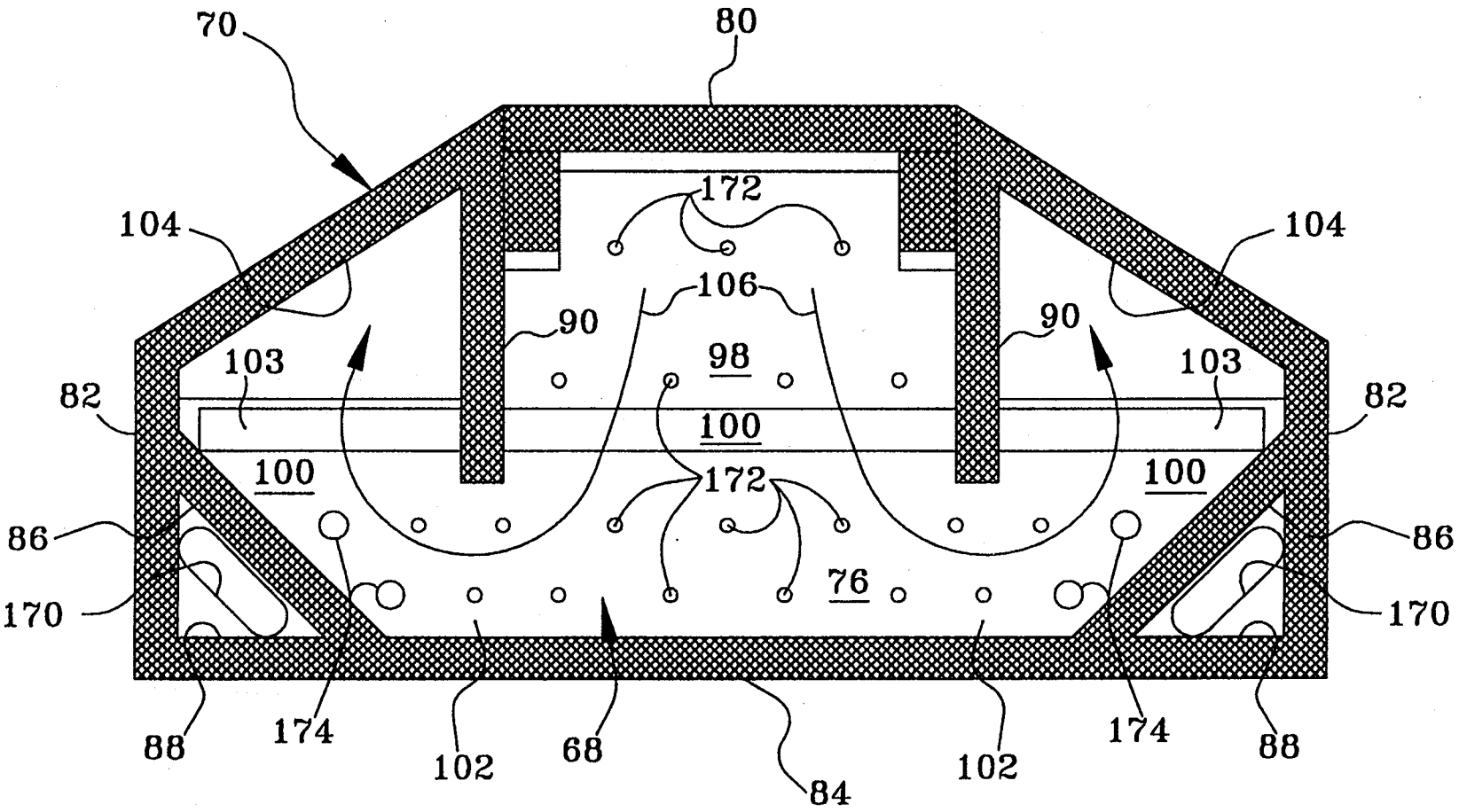

The upper end 66 of passage 56 opens into a mixing and combustion chamber 68 located in upper portion 70 of secondary combustion unit 54. Portion 70 is illustrated in FIGS. 10 and 11 and is shown in vertical section in FIG. 2. A secondary air distribution chamber 72 is located in upper portion 70 above chamber 68. Chamber 72 will be described in connection with the description of the combustion air and secondary air distribution systems of stove 10.

As illustrated in FIGS. 10 and 11, the upper portion 70 of the secondary combustion unit 54 includes a bottom wall 74 resting on the upper surface of firebox top wall 44, a top wall 76 spaced a distance above bottom wall 74 and a circumferential wall 78 extending around the outer edges of the top and bottom walls to define chamber 68. Wall 78 includes a rear wall 80, end walls 82 and front wall 84. Diagonal interior walls 86 extend between the adjacent ends of the front and side walls to define flow passages 88 extending through the thickness of the upper portion 70 and communicate with the distribution chamber 72. The ends of the rear walls 80 joining walls 82 are bent forwardly toward the front wall in order to facilitate fitting the portion 70 within the top of the stove and to shape chamber 68. A pair of interior walls 90 extend from rear wall 80 into the chamber 68 to ends 92 spaced a distance from the front wall. As shown in FIG. 2, ends 92 are sloped rearwardly with the bottoms of walls 90 extending closer to the front wall 84 than the tops of the walls 90.

The upper end 66 of combustion passage 56 extends through bottom wall 74 and opens into the chamber 68 adjacent rear wall 80 between interior walls 90. An aperture plate 94 formed of high temperature refractory material is mounted in the lower wall 74 between plates 90 so that the small diameter apertures 96 extending through the plate communicate the interior of the firebox or primary combustion chamber 24 with the interior of mixing and secondary combustion chamber 68. A relatively large number of apertures 96 are provided in plate 94 in order to facilitate the desired flow of combustion gases into the chamber 68 while promoting good mixing of gases entering and reducing heat loss from the chamber.

The walls 80, 82, 84, 86 and 90 divide the chamber 68 into a central portion 98 located between front and rear walls 80 and 84 and interior walls 90 and above plate 94 and the upper end 66 of passage 56, and two lateral portions 100 located to either side of the central portion between the ends of walls 80 and 84, end walls 82, diagonal interior walls 86 and interior walls 90. The interior portion is connected to the lateral portions at passages 102 located between the ends 92 of walls 90 and the front wall 84. Generally triangular outlet openings 104 are formed through top wall 76 between the lateral ends of rear wall 80 and interior walls 90. The openings communicate chamber 68 with the collection chamber 50 located in the top of stove 10.

A baffle ridge 101 extends across the top wall of central portion 98 slightly inwardly of wall ends 92. Similar ridges 103 extend downwardly a short distance from the top wall of lateral portions 100 adjacent the outlet openings 104. See FIG. 11.

Combustion gases flow through chamber 98 along two passages indicated arrows 106. Combustion gases flow up into central portion 98 through mouth 66 and the apertures 96 of plate 94, and divide into two U-shaped flows at the front wall 84. Each flow passes through a U-shaped flow path extending from the central portion 98 past a passage 102 and into a lateral portion 100. The flows exit chamber 68 through outlets 104 and enter chamber 50. The gas is dragon out from chamber 50 through the flue outlet by natural draft.

Stove 10 includes a draft-induced primary combustion air flow system 152 for flowing primary combustion air into the firebox 24 and a draft-induced secondary air flow system 154 for flowing secondary combustion air into the secondary combustion unit 54. The system 152 includes an adjustable valve 156 for controlling the amounts of air flowing through the system and properly directing the flow of primary combustion air dependent upon whether stove 10 is burning wood as a fuel or coal as a fuel.

Primary and secondary combustion air inlet port 110 is formed in stove bottom wall 22 and communicates with an inlet chamber 112 under the ash pit bottom wall 114 extending to the corners of the stove to either side of front wall 12. A pair of vertical manifolds communicating with chamber 112 open into the ends of a cross manifold 118 extending across the front of the stove at the level of the top of ash door 34. A combustion air bleed opening 120 is provided on the inner wall of each manifold 116 a short distance below manifold 118 to flow a volume of primary combustion air into the ash pit at the level of grate 26.

Cross manifold 122 extends across the front of the stove immediately above manifold 118 and is connected at its ends to vertical manifolds 124 which extend upwardly at the corners of the front of the stove to another cross manifold 126 extending across the front of the stove at the level of the top of access door 30. Manifold 126 cooperates with the inner surface of glass panel 32 to define a primary combustion air flow mouth 128 at the inner top of the panel 32. Primary combustion air flows upwardly through manifolds 124 to manifold 126 and is directed downwardly through the mouth 128 and over the interior surface of the panel 32 to prevent condensation of combustion products on the interior of the panel.

Figure 4:
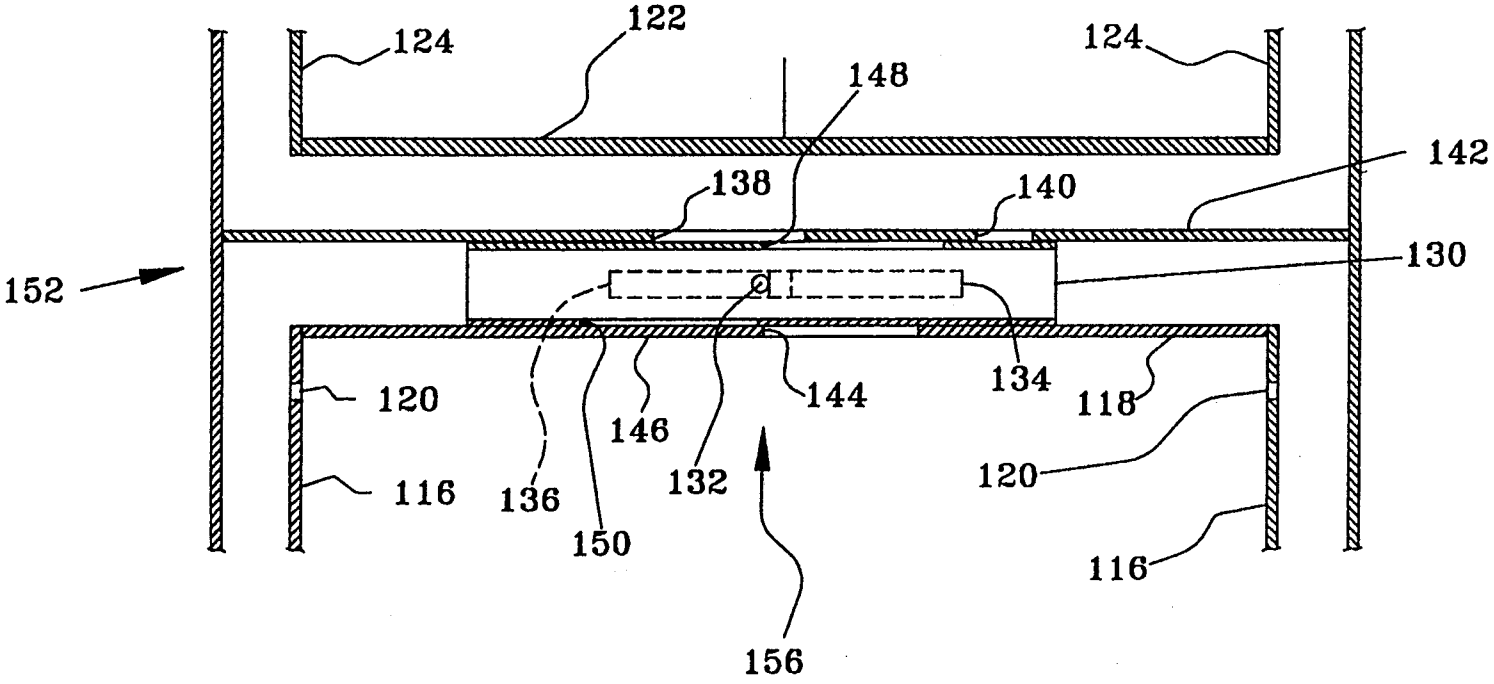
Figure 5:
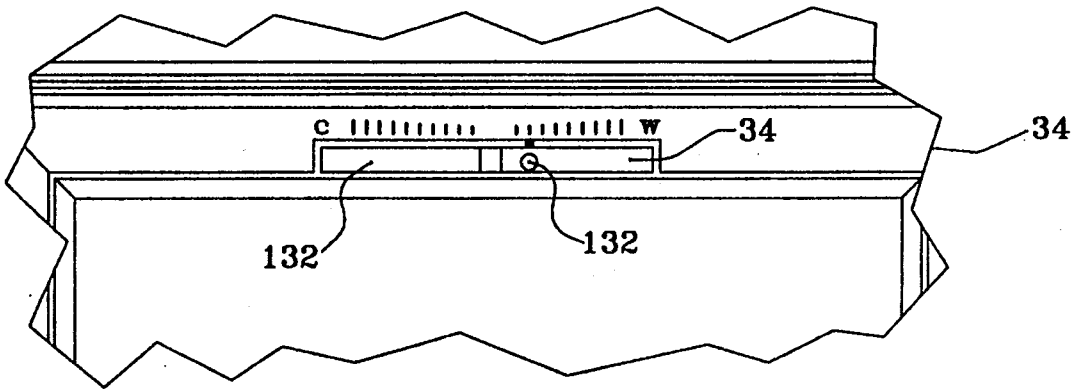
Figure 6:
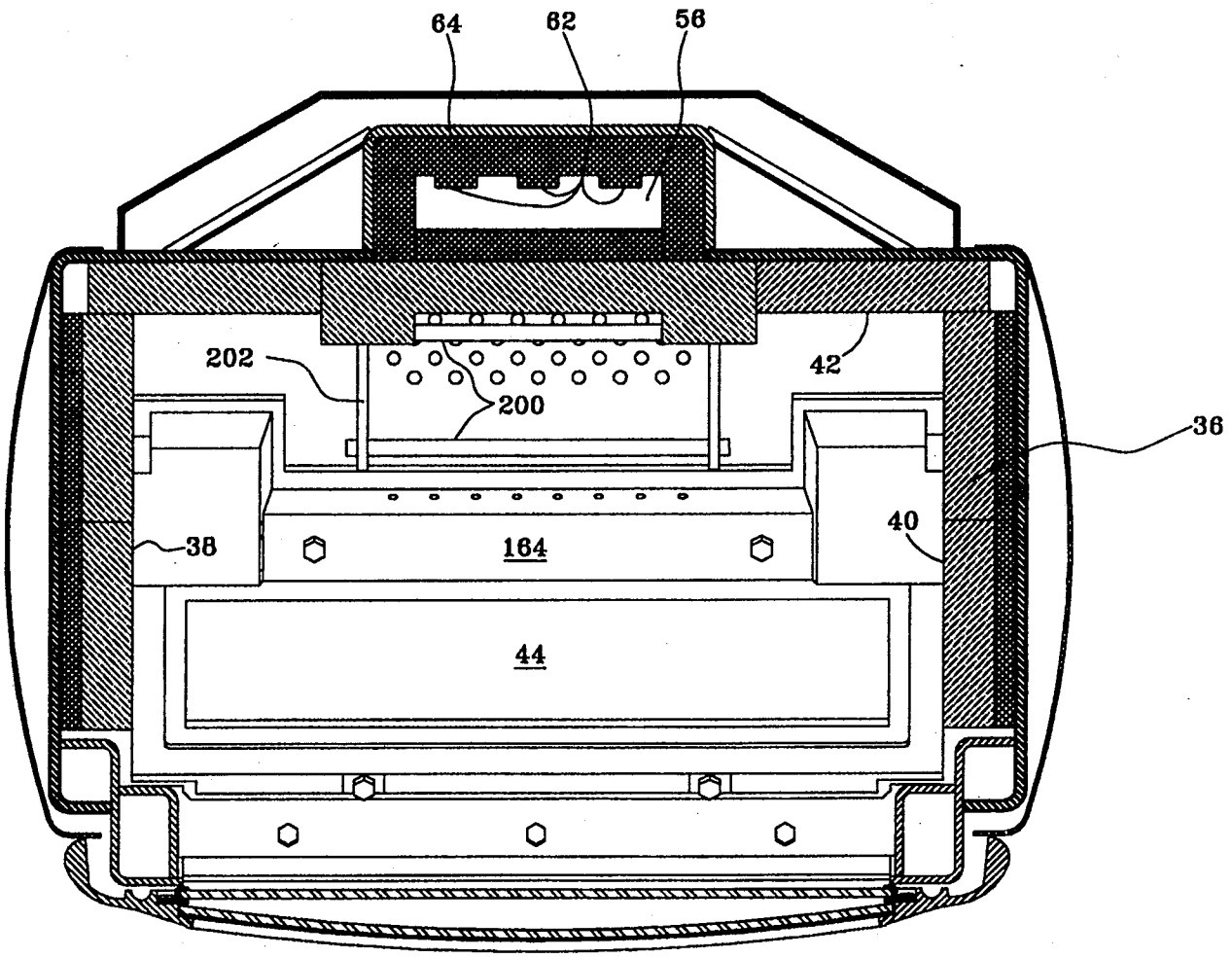

As shown in FIG. 4, valve 156 includes a tubular valve member 130 fitted in manifold 118 and laterally shiftable within the manifold. A rod-like handle 132 is removably threaded to the front side of the valve member and extends outwardly of the manifold through a single horizontal slot in the front end of the manifold and through one of two horizontal slots 134 and 136 formed in the top of the lower ash door 34. Combustion air flow openings 138 and 140 are formed in wall 142 separating manifolds 118 and 122. A primary combustion air flow opening 144 is formed in bottom wall 146 of manifold 118. A flow opening 148 is formed in the top wall of valve member 130 and a flow opening 150 is formed in the bottom wall of the valve member.

FIG. 4 illustrates the valve member with handle 132 extending through the control slot 136 for flow of combustion air to the firebox 24 when burning wood in the stove. With handle 132 as shown the valve is in a low burn position with openings 148 and 138 overlapping slightly to permit a limited flow of primary combustion air from port 110 through chamber 112, up the manifolds 116 and into the cross manifold 118, through the overlap opening and into the cross manifold 122 and then up the vertical manifolds 124 to the elevated cross manifold 126 and then through mouth 128 and down across the interior of the viewing panel 32. Movement of the pin to the right as shown in FIG. 1 shifts the valve member 130 to the left as shown in FIG. 4 to enlarge the flow area between manifolds 118 and 122 and increase the volume of primary combustion air flowed into the firebox through mouth 128. As the valve member is moved toward the full open position with pin 132 at the outer end of slot 136, the end of the valve member moves past opening 140 to further increase the volume of combustion air flowing into the firebox. When wood is burned as a fuel a limited amount of air is continuously flowed into the ash pit through bleed openings 120 and opening 144 is closed.

The stove is converted from wood burning to coal burning by simply opening the ash door 34 and moving the handle pin 132 to the left so that it falls within coal slot 134. When the handle is positioned at the inner end of slot 134 as shown in FIG. 1, opening 150 in the bottom of the valve member partially overlaps with opening 144 to permit a limited flow of combustion air into the ash pit for upward flow through coal supported by grate 26. Further movement of the handle 132 to the left toward the outer end of slot 136 gradually increases the overlap between openings 150 and 144 to increase the flow of primary combustion air into the ash pit 28. When handle 132 is in the low burn coal position, opening 138 is closed and opening 148 partially overlaps with opening 140 to provide a small flow of combustion air to manifold 122 to provide a downwardly flow of combustion air from mouth 128 and the inner surface of the panel 132. Movement of the handle 132 away from the center of the stove to the high burn position initially increases the overlap between openings 148 and 140 to provide an increased downward flow of combustion air through mouth 128. In this way, sufficient combustion air is flowed downwardly along the inner surface of the panel during coal burning to protect the inner surface of the panel from deposits of combustion products.

The manifolds 116, 118, 122, 124, and 126 together with the valve 156 form combustion air distribution system 152 for flowing proper amounts of combustion air to the firebox 24 depending upon the type of fuel burned in the firebox and the level of heat at which the stove 10 is operated.

Continuously operating, non-adjustable secondary combustion air flow system 154 flows air to the combustion passage 56 and combustion chamber 68 of the secondary combustion unit 54. System 154 includes a pair of vertical manifolds 160 located in the front corners of the stove outwardly of manifolds 116. The lower ends of manifolds 160 open into inlet chamber 112. The manifolds extend vertically to the top of the firebox 24 and are connected to the upper ends of side manifolds 162 which extend downwardly along the outer edges of the top wall 44 and are joined to the ends of a cross manifold 164 extending completely across the width of the firebox top wall 44 as shown in FIG. 8. The cross manifold 164 is located on the top wall between damper 46 and perforated plate 94. A row of small secondary combustion air discharge openings 165 extends through the side of manifold 164 adjacent plate 94. Jets of secondary combustion air flow outwardly from openings 165 and extend over plate 94.

Figure 9:
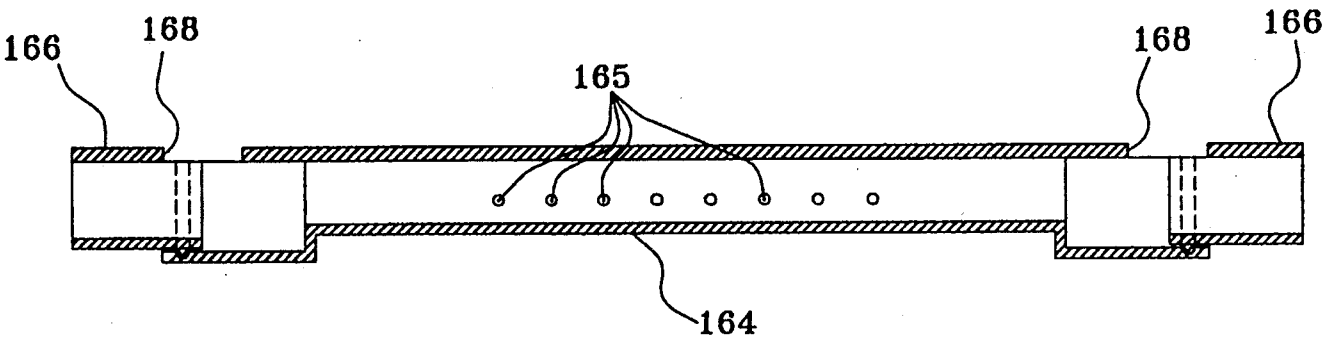

FIG. 9 illustrates manifold 164. The lateral ends 166 of the manifolds are joined to side manifolds 162. A pair of discharge openings 168 are provided in the top of the manifold adjacent the ends. These openings communicate the manifold with passages 88 formed in the front corners of upper portion 70 of the secondary combustion unit 54. See FIG. 10. As indicated in FIG. 11, openings 170 formed in the upper ends of passages 88 communicate the passages to the lateral ends of secondary air distribution chamber 72 formed in the top of upper portion 70 of the secondary combustion unit 54.

Figure 12:
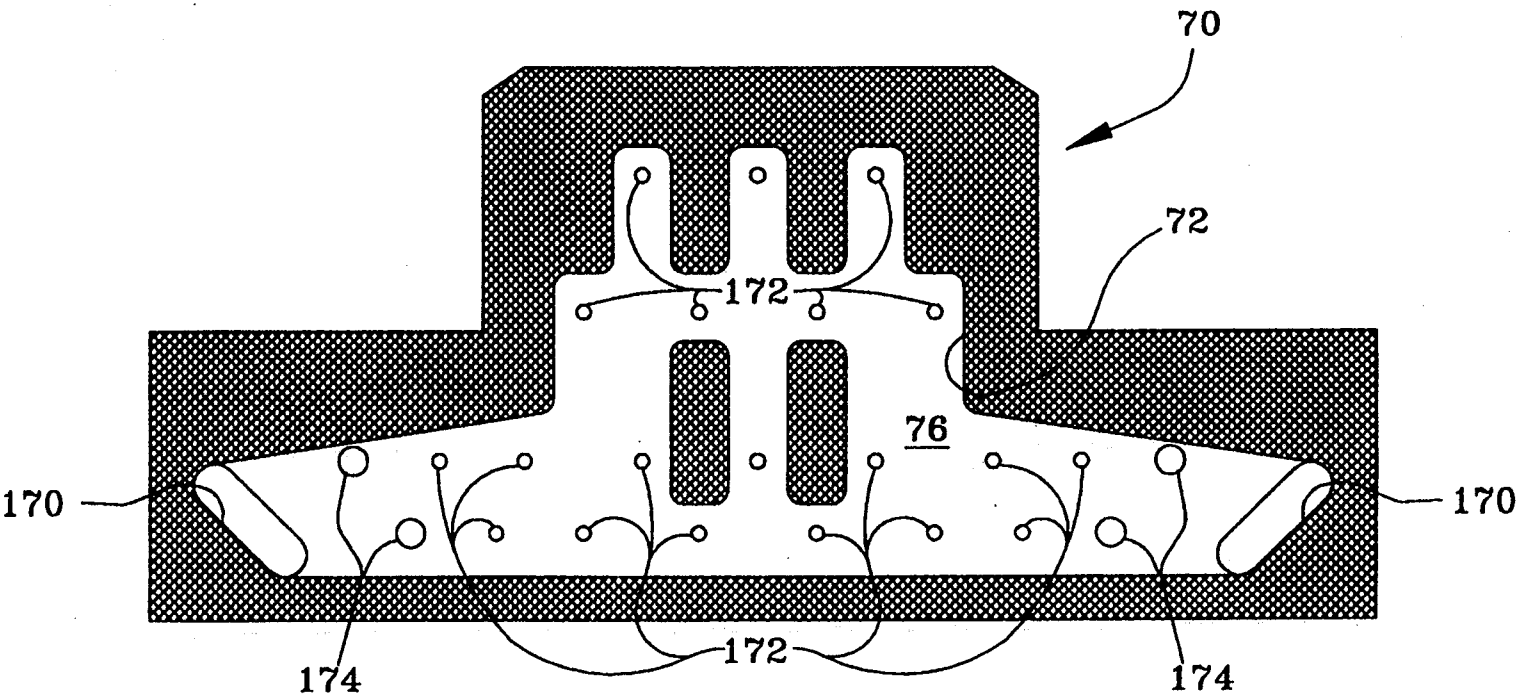

Secondary air distribution chamber 72 is located above the central portion 98 of mixing and secondary air combustion chamber 68, passages 102 and the lateral portions 100 of the chamber. As illustrated in FIGS. 11 and 12, a plurality of relatively small diameter flow of secondary combustion air holes 172 extend through the top wall 76 of chamber 72 to flow secondary combustion air from chamber 72 down into the top of the central portion 98 of chamber 72 and into the lateral portions 100 and passages 102 connecting the central and lateral portions. A pair of large diameter holes 174, larger than holes 172, extend through wall 76 to flow a large volume of combustion air into the lateral portions 100 of chamber 68 to mix with combustion gases flowing through the chamber prior to these gases exiting the chamber through openings 104.

Figure 7:
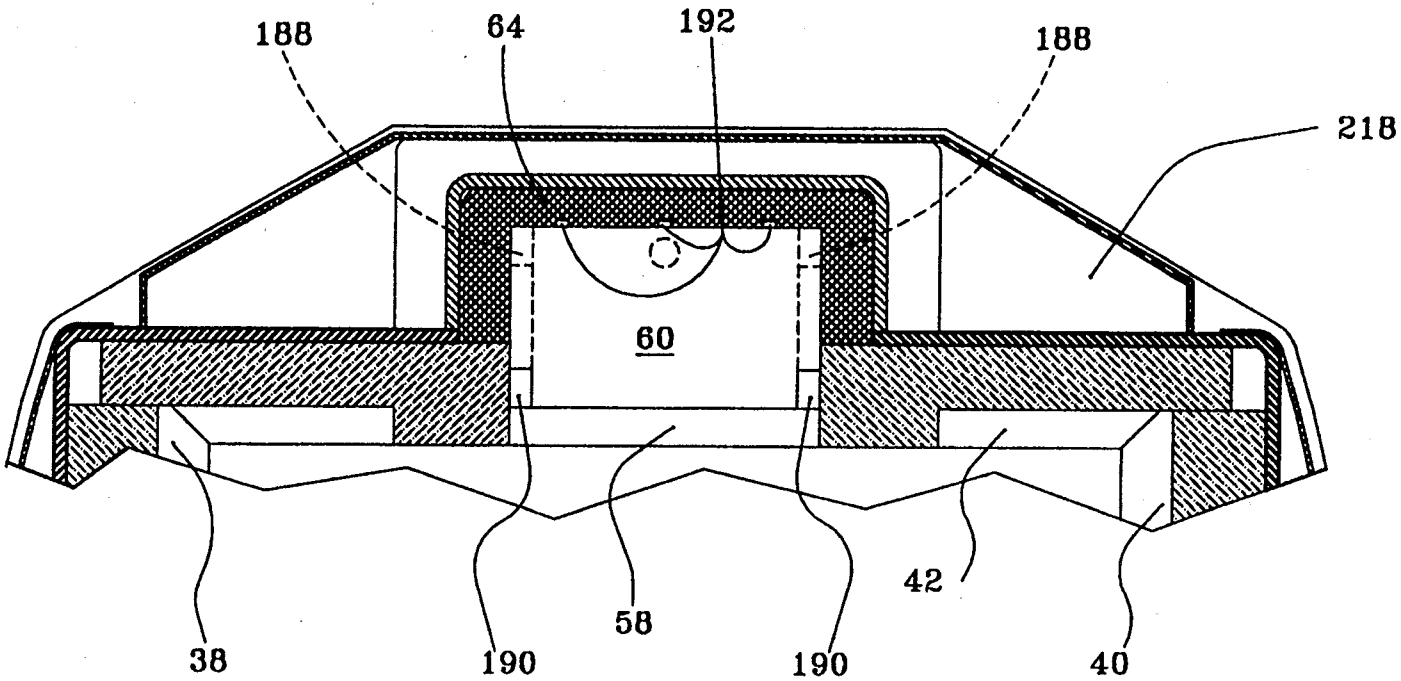

The secondary combustion air flow system 154 also includes an inlet chamber 180 extending along the back of the bottom of stove 10 and communicating with inlet port 110 as illustrated in FIG. 2. Chamber 180 communicates with upwardly extending manifold 182 which in turn communicates with a chamber 184 located behind the wall 186 forming lower surface 60 of mouth 58. A pair of downwardly sloping flow passages 188 shown in FIGS. 2 and 7 are formed in the lateral sides of wall 188 and communicate the upper end of chamber 184 with mouths 190 located at the lower end of the wall adjacent the bottom of mouth 58. Three shallow air flow passages 192 are formed in wall 64 and extend upwardly from the chamber 184 past wall 186. The upper ends of the passages 192 are located under the three mixing ribs 62 in order to promote mixing of combustion air flowing up through the passages with combustion gases flowing through mouth 58 and into combustion passage 56.

During operation of stove 10, whether burning wood as a fuel or coal as a fuel, the natural draft continually draws secondary combustion air through the secondary combustion air flow system 154 so that combustion air is continuously flowed from holes 165 through mouths 190 into the mouth 58 of passage 56 and through holes 172 and 174 into the mixing secondary combustion chamber 68.

A pair of metal rods 200 are mounted on firebox top wall 44 by support brackets 202. Rods 200 are spaced from and extend across the aperture plate 94 to protect the plate from contact when fuel, particularly large pieces of wood, is placed in the firebox.

A grate operator 204 shown in FIG. 1 extends outwardly of stove side 16 and is connected to the grate 26 by a conventional rocking drive (not illustrated). A handle may be attached to the operator and rotated to rock the grate in a conventional manner when the stove 10 is used to burn coal.

Stove 10 heats surrounding air by natural convection, forced air flow heating and radiation. Sheet metal side panels 206 are spaced outwardly of the sidewalls of the primary combustion chamber and define vertically extending heating passages 208 extending upwardly from inlet mouths 210 located at the bottom of the stove to discharge mouths 212 located at the top of the stove. Air in the passages 208 is heated and flows up and out through mouths 212, as cooler air is drawn into the passages through mouths 210. The forced air heating system includes a blower (not illustrated) mounted on the lower rear of the stove and arranged to flow air through an opening 214 formed through stove back panel 216. The forced air flows upwardly through a vertical passage 218 along the back of the fire box and the secondary combustion unit 54, around chamber 50, through passage 220 located at the top of the stove above chamber 50 and through outlet openings 222 at the upper front of the stove as shown in FIG. 1. The blower has multiple air flow settings to provide control over the temperature of exiting air.

The operation of wood and coal burning stove 10 will now be described, starting with a description of operation of the stove as a wood burning stove.

When stove 10 burns wood as fuel, handle 132 extends outwardly from slot 136 so that valve 156 is in position to flow primary combustion air out mouth 128 and down across the inner surface of the viewing panel 32. This flow of air prevents condensation of combustion products on the panel. As the downward flow of air moves toward the bottom of the pane, it is deflected rearwardly toward the wood on grate 26 by angled bars 230 which are mounted on manifolds 124 and extend across the front bottom of firebox 24, and by downwardly sloping beveled surface 232 forming the top wall of manifold 122. The flow of air passes over and through the charcoal and wood on the grate 26. The wood may be in the form of relatively large diameter logs and may fill as much as the bottom half or more of the firebox. The rearward flow of primary combustion air passes over and through the fuel and supports primary combustion of the fuel in box 24. The primary combustion of fuel in the firebox produces combustion gases including volatilized unburned pollutants.

The gases are divided into two flows. Part of the combustion gases flow upwardly from the burning wood along back wall 42 and pass through the perforations or holes in plate 94 and into the mixing and secondary combustion chamber 68 of secondary combustion unit 54. A second flow of combustion gas flows rearwardly into throat 58 of combustion passage 56, is drawn up the passage 56 and then flows through the upper end of the passage 66 and into the back of chamber 72. During burning of fuel in stove 10, secondary combustion air is continuously flowed down passages 188 and out mouths 190 into the mouth 58 of combustion passage 56. This air provides additional oxygen to both stimulate combustion of charcoal in front of the mouth 58 and facilitate secondary combustion of the unburned constituents in the combustion gas as the gas flows up through the well insulated and high temperature passage 56.

Additional secondary combustion air is flowed into the passage 56 through passages 192 which open below mixing ribs 62. The secondary combustion air flowed through the passages 192 is dispersed into the combustion gas as it flows to either end of and around the mixing ribs, in order to distribute additional oxygen into the gas as the gas flows into passage 56. In this way, considerable secondary combustion air is mixed into the combustion gases flowing into and up passage 56. This combustion air provides additional oxygen in gases moving up the passage to facilitate high temperature burning of the unburned vaporized pollutants generated during primary combustion of wood in the central firebox 24. The refractory material surrounding passage 56 effectively insulates the passage and assures maintenance of a high temperature within the passage. This temperature may be as high as 1,500 degrees Fahrenheit at upper end 66.

Combustion gases generated by burning wood in the bottom of the firebox flow up along rear wall 42 and into the chamber 68 through the openings in plate 94. The secondary combustion air flow system 154 flows jets of secondary combustion air out through the openings 165 in manifold 164 so that the jets penetrate the upward flow of combustion gases from the bottom of the firebox 24 immediately below plate 94. When the stove 10 is at a high burn, fuel burning in the chamber 24 can generate sufficiently high temperature combustion gases flowing upwardly and passing through the plate 94 to mix with and ignite with the jets of secondary combustion air immediately below the plate 94. The burning jets are drawn into chamber 68 together with the combustion gases. This flow of hot gas through the plate and the high temperature combustion in central portion 98 of chamber 68 may heat the plate red hot. The burning jets have a very pleasing appearance when viewed through panel 32, and are much like the flame of a gas broiler or gas log.

The combustion gases flow through the holes in plate 94 and into chamber 68. The secondary combustion air flowing over the plate 94 adds additional oxygen to the combustion gases being flowed into the chamber 68 in order to promote the high temperature combustion of pollutants in the combustion gases as the gases flow through the upper portion 70 of the secondary combustion unit 54.

The high temperature combustion gases exiting from the upper mouth 66 of passage 56 mix with the combustion gases flowing into the chamber 68 through the holes in plate 94 to heat and effectively burn all pollutants flowed through chamber 68. The burning of combustion products in chamber 68 is supported by a downward flow of secondary combustion air through holes 172 and 174. This flow provides a steady enrichment of oxygen to the combustion gases as the gases flowing up chamber 56 unite with the gases flowing into the chamber through the plate 94 immediately above the plate and as the combined flow moves along the central portion 98 from rear wall 80 toward front wall 84, is divided into two generally equal portions, and flows through the passages 102 into the lateral portions 100 of chamber 68 along U-shaped paths. Openings 172 are relatively small in diameter to assure that the flow of secondary combustion air into the combustion gases is not sufficient to reduce the temperature of the combustion gases below the temperature required for efficient burning of pollutants.

The flow through the holes 172 and 174 is continuous during operation of the stove and is dependent upon the induced draft in the stove. When the stove is burning wood at a relatively low rate the flow through the openings and into the chamber 64 is less than the flow when the stove is burning wood at a high burn rate and a large volume of combustion gases are generated in the firebox. The number of openings and diameter of the openings through which secondary combustion air is flowed into chamber 68 are calculated to assure that adequate secondary combustion air is added to the combustion gases flowing through the passage independent of volume of the gasses to assure that pollutants are thoroughly burned. At low flow rates all pollutants may be burned before combustion gas flows to lateral portions 100 of chamber 68.

Large diameter holes 174 are provided adjacent the end of the passage, near outlets 104, in order to flow a large volume of secondary combustion air into the combustion gases and assure that any possible remaining pollutants in the gases are burned prior to the combustion gases leaving the high temperature chamber 68. The baffle ridges 101 and 103 promote turbulence in the gases flowing through the chamber so that the oxygen in the combustion air is more uniformly mixed with the combustion gases to promote uniform burning of pollutants.

At high burn rates, the temperature in the center portion of chamber 68 may be as high as 2,000 degrees Fahrenheit. Combustion at this high temperature assures that pollutants in the combustion gas are burned. The walls 90 which extend into chamber 68 effectively increase the length of the flow path for the combustion gases, as indicated by arrows 234 shown in FIGS. 10 and 11. The increased length increases the residence time the combustion gases are held in the passage and, consequently, the time during which the gases are maintained at a high temperature for burning pollutants. Long divided U-shaped flow paths are provided in chamber 68 in order to assure complete burning of pollutants within the limited space available for the chamber in the top of stove 10.

A fresh load of wood placed in the firebox of stove 10 must be dried and heated before it will burn. When the wood reaches combustion temperature, it gives off volatile gases including pollutants. A portion of these gases flow upwardly through the firebox, through the perforations in plate 94 and into chamber 68. However, because the wood is at a low combustion temperature, gases driven off from the wood are often at a temperature too low to support burning with the combustion air jets from manifold 164 prior to entry into the chamber 68. Secondary combustion air flowed outwardly from manifold 164 mixes with these gases outside of plate 94 and is drawn into the chamber with the gases for combustion. The oxygen in this air aids combustion in chamber 68.

During the heating the remaining gases are drawn into the ignitor mouth 58 through charcoal remaining from the previous fuel load. This charcoal is further stimulated by air flowing into the charcoal from bleed openings 120 and passages 188 to generate hot combustion gases which flow into mouth 58, up through the high temperature combustion passage 56 and into the chamber 68 above plate 94. These hot gases heat the cooler gases flowing into chamber 68 through plate 94 to burn pollutants in the gas as previously described.

When the wood in the firebox has been heated sufficiently for sustained burning, the combustion of the wood generates a relatively large volume of combustion gases which flow into the secondary combustion unit 54 through both plate 94 and mouth 58. These hot and very combustible gases mix with the secondary combustion air flowed outwardly of manifold 164 below plate 94 and frequently burn outside of the plate as previously described. The burning gas is drawn through the apertures in the plate and into the chamber 68 to complete combustion in the chamber as described. The portion of the combustion gases drawn through mouth 58 and into the vertical combustion passages 56 is burned in the passage and chamber 68. In this way, all emissions generated during active burning of wood in the firebox are burned in the secondary combustion unit 54 to produce a clean virtually pollution-free exhaust gas.

During the later stage of combustion, the wood in the firebox is reduced to a pile of ash and coals resting on the grate 26 and, in part, on the lower surface 60 of mouth 58. During this stage, polluting components of the wood have largely been removed and the remaining carbonized wood burns relatively cleanly. Any remaining polluting emissions are burned as the exhaust gases are flowed through unit 54. If charcoal cover mouths 190, secondary combustion air from mouths 190 is drawn directly through the remaining fuel to promote continued burning of the remaining charcoal. The downwardly angled surface 60 at the bottom of mouth 58 helps prevent a build-up of embers and ashes in the mouth to a sufficient height to cover mouth 58 and prevent or restrict flow of combustion gases up through passage 56.

During operation of stove 10, secondary combustion of pollutants occur at three locations: in the vertical combustion or ignitor passage 56; below plate 92 at the jets of secondary combustion air supplied by manifold 164; and in the central and lateral portions of mixing and secondary combustion chamber 68. Stove 10 will burn cleanly within present federal EPA requirements if secondary combustion is maintained at one of these three locations. This condition is met by following relatively simple operating procedures for the stove including assuring that the stove is reloaded with a new charge of wood while there is an adequate amount of live charcoal maintained on the grate 26 sufficient to permit rekindling of combustion in the firebox. The primary combustion air flow system 152 and secondary combustion air flow system 154 operate without adjustment with the exception that the operator may shift the handle 132 as previously described to control the burn level of the stove.

Stove 10 burns wood and produces a clean exhaust gas despite having an open bottom in the primary combustion chamber 24 defined by grate 26. The ability to burn wood cleanly on a grate permits the stove to also burn coal. In order to burn coal without a stoker, it is necessary to support the coal on a grate and flow primary combustion air up past the grate and through the supported pile of coal. Coal will not burn efficiently when supported on a flat imperforate floor.

The operation of stove 10 burning coal as a fuel will now be described.

In order to burn coal in the stove it is necessary to open the ash door 34 and position handle 132 in slot 134. Shifting of the valving member assures that a major portion of the primary combustion air is flowed directly into the ash pit 28 below the fuel for upward flow through the coal. A portion of the primary combustion air is flowed upwardly through manifolds 124 in order to maintain a downward flow of air over the inner surface of panel 32 to prevent buildup of impurities on the panel.

Initial heating of coal in the firebox 24 may drive off some volatile pollutants from the coal. Flowing these pollutants through the secondary combustion unit 54, as described in connection with operation of this stove using wood as a fuel, burns the pollutants. After initial heating of the coal and driving off of volatile impurities, stove 10 may be operated with damper 46 open. Operation in this manner restricts or eliminates flow of combustion gases through the secondary combustion unit with the advantage that any fly ash entrained with the combustion gases is flowed directly out of the stove and does not collect in the combustion unit 54.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A heating stove for burning solid fuel cleanly, the stove comprising:

A) a firebox having a back, side walls, a front wall, a top and a floor, a refractory lining on said back and side walls, the front wall including an access door having a transparent panel for viewing the interior of the firebox;

B) a secondary combustion unit mounted on the top and back wall of the firebox, said unit being formed from high temperature refractory material and including a lower portion and an upper portion, the lower portion defining a combustion passage extending along the back wall of the firebox and having a mouth at the lower end of the combustion passage opening into the firebox at the level of fuel placed on the floor for burning and an upper end located adjacent the top of the back wall, the upper portion including walls defining a mixing and secondary combustion chamber, a combustion gas inlet opening communicating the mixing and secondary combustion chamber with the top of the firebox, a first mixing and secondary combustion chamber outlet opening located a distance from the combustion gas inlet opening, and a first combustion path in said mixing and secondary combustion chamber extending from the inlet opening to the first outlet opening, the upper end of the combustion passage opening into said chamber adjacent the back wall of the firebox;

C) a primary combustion air flow system for the firebox; and

D) a secondary combustion air flow system for the mixing and secondary combustion chamber.

2. A stove as in claim 1 wherein said combustion gas inlet opening comprises a plurality of closely spaced apertures extending through a body of refractory material.

3. A stove as in claim 1 wherein the secondary combustion air flow system includes a first plurality of air flow openings in the upper portion of the secondary combustion unit spaced along said first path.

4. A stove as in claim 3 wherein said air flow openings are formed in a wall in the upper portion above the mixing and secondary combustion chamber.

5. A stove as in claim 4 wherein the secondary combustion air flow system includes a secondary air distribution chamber located in said upper portion in communication with said openings and an air flow passage communicating the air distribution chamber with an air inlet port.

6. A stove as in claim 3 wherein said upper portion of the secondary combustion unit includes a second combustion chamber outlet opening located a distance from the combustion gas inlet opening and spaced from said first outlet opening, and a second path in said mixing and secondary combustion chamber extending from the inlet opening to the second outlet opening and wherein the secondary combustion air flow system includes a second plurality of air flow passages in a wall in the upper portion of the secondary combustion unit spaced along said second path.

7. A stove as in claim 6 wherein said inlet opening is located between said outlet openings.

8. A stove as in claim 6 wherein said outlet openings are located in the top of the upper portion.

9. A stove as in claim 8 wherein said inlet opening is located between said outlet openings.

10. A stove as in claim 6 wherein the secondary combustion air flow system includes a distribution chamber formed in the top of the upper portion, said chamber communicating with said first and second plurality of air flow openings, and an air flow passage communicating the air distribution chamber and an air inlet port.

11. A stove as in claim 1 wherein the secondary combustion air flow system includes first distribution means located within the firebox for flowing secondary combustion air over the combustion gas inlet opening.

12. A stove as in claim 11 wherein the secondary combustion air flow system includes second distribution means for flowing secondary combustion air into the mouth of the combustion passage.

13. A stove as in claim 12 wherein the secondary combustion air flow system includes third distribution means for flowing secondary combustion air into the combustion passage and said lower portion includes mixing means within the combustion passage for mixing secondary combustion air from the third distribution means with combustion gases flowing through such passage.

14. A stove as in claim 13 wherein said first mixing means comprises a rib extending into the combustion passage.

15. A stove as in claim 1 wherein said first combustion path is U-shaped.

16. A stove as in claim 1 wherein said upper portion of the secondary combustion unit includes a second combustion chamber outlet opening located a distance from the combustion gas inlet opening and a second combustion path in said mixing and secondary combustion chamber extending from the inlet opening to the second outlet opening and wherein both outlet openings are formed in the top of the upper portion.

17. A stove as in claim 16 wherein both said combustion paths are U-shaped.

18. A stove as in claim 17 wherein said inlet opening is located between said outlet openings.

19. A stove as in claim 1 including a fuel-supporting grate at the bottom of the firebox, and wherein the primary combustion air flow system includes a bleed opening for flowing a small volume of bleed air into the space below the grate.

20. A stove as in claim 19 for burning either wood or coal as fuel wherein said primary combustion air flow system includes valve means for selectively either 1) flowing a large volume of primary combustion air into the firebox while preventing flow of primary combustion air below the grate with the exception of bleed air when burning wood or, 2) flowing a large volume of primary combustion air below the grate and restricting flow of primary combustion air into the firebox when burning coal.

21. A stove as in claim 20 wherein said valve means includes a valve member shiftable between a wood burning position and a coal burning position, a handle joining said valve member, a coal burning slot and a wood burning slot, said handle extending through the wood burning slot for manual engagement and movement of the valve member to adjust the rate of flow of primary combustion air to the firebox when burning wood and said handle extending through the coal burning slot for manual engagement and movement of the valve member to adjust the rate of flow of primary combustion air below the grate when burning coal.

22. A stove as in claim 21 including an ash pit below the grate, an ash door in the front wall, said slots being formed in the ash door.

23. A stove as in claim 1 wherein the lower surface of the combustion passage mouth slopes downwardly into the firebox.

24. A stove as in claim 21 wherein the primary combustion air flow system includes a flow outlet at the combustion passage mouth.

25. A stove as in claim 1 wherein the primary combustion air flow system includes a bleedoutlet located under the firebox floor for flowing bleed primary combustion air up through the floor and into the firebox.

26. A heating stove for cleanly burning solid fuel comprising,

A) a firebox having a floor, a back wall, side walls, a front wall and a top wall;

B) a primary combustion air flow system for the firebox;

C) a high temperature secondary combustion unit including, i) a combustion passage having a mouth opening into the firebox through a wall adjacent the floor and an upper end opening into the mixing and secondary combustion chamber, ii) a mixing and secondary combustion chamber at the top of the firebox having a combustion gas inlet opening communicating the chamber and the top of the firebox, said inlet opening being located adjacent the upper end of the combustion passage, and a first outlet opening remote from the combustion gas inlet opening for flowing combustion gases out of the mixing and secondary combustion chamber, iii) the chamber defining a first mixing and combustion passage for burning pollutants, said passage extending from the combustion gas inlet opening to the outlet opening; and D) a secondary combustion air flow system for the combustion chamber.

27. A stove as in claim 26 wherein said combustion gas inlet opening comprises a perforated plate.

28. A stove as in claim 27 wherein said plate is formed from a refractory material.

29. A stove as in claim 26 wherein said secondary combustion air flow system includes a distribution chamber formed in the secondary combustion unit and a plurality of holes communicating the distribution chamber and the combustion chamber, said holes being spaced along the combustion passage.

30. A stove as in claim 29 wherein air flow holes provide a greater volume of air to the passage adjacent said first outlet opening than adjacent the inlet opening.

31. A stove as in claim 29 wherein one or more air flow holes opens into the combustion chamber adjacent the upper end of the combustion passage.

32. A stove as in claim 31 wherein said combustion gas inlet opening is located on one side of the combustion chamber and at least one of said air flow holes is located on the opposite side of said chamber across from the combustion gas inlet opening.

33. A stove as in claim 26 wherein said first combustion passage is U-shaped.

34. A stove as in claim 26 wherein the secondary combustion unit includes a second outlet opening and the combustion chamber defines a second combustion passage extending from the combustion gas inlet opening to the second outlet opening.

35. A stove as in claim 34 wherein both said first and second combustion passages are U-shaped.

36. A stove as in claim 29 wherein, said combustion gas inlet opening is located at the back of the top of the firebox, said vertical combustion passage extends upwardly along the back wall of the firebox, the upper end of the combustion passage opens into the lower wall of the combustion chamber behind the combustion gas inlet and wherein said air flow openings are located chamber above the upper end of the combustion passage and the combustion gas inlet opening.

37. A stove as in claim 34 wherein both said first and second combustion passages are U-shaped and said first and second outlets are located to either side of the combustion gas inlet opening.

38. A stove as in claim 26 wherein said floor comprises a grate, an ash pit below the grate, and the first air flow system including a bleed opening for flowing a small amount of primary combustion air up through the grate.

39. A stove as in claim 38 wherein the lower wall of said mouth extends downwardly at an angle of approximately 45 degrees.

40. A stove as in claim 26 wherein said secondary combustion air flow system includes a manifold on the top wall of the firebox adjacent the gas inlet opening and at least one air flow opening in the manifold adjacent the gas inlet opening for flowing secondary combustion air into combustion gases flowing through the inlet opening.

41. A stove as in claim 40 wherein said gas inlet opening comprises a plurality of apertures formed in a plate of refractory material.

42. A stove as in claim 40 wherein said manifold includes a plurality of spaced air flow openings for flowing a plurality of jets of secondary combustion air over the plate.

43. A stove as in claim 26 wherein the secondary combustion air flow system includes means for flowing secondary combustion air into the mouth of the combustion passage adjacent the firebox floor.

44. A stove as in claim 43 wherein said secondary combustion air flow system includes a plurality of air flow mouths located at the bottom of said combustion passage mouth and facing the interior of the firebox whereby secondary combustion air flowed through such mouths circulates through fuel supported on said floor.

45. A stove as in claim 43 wherein said secondary combustion air flow system also includes a secondary air flow passage opening into the combustion passage.

46. A stove as in claim 43 wherein said secondary combustion air flow system includes a plurality of secondary air flow passages opening into the lower end of said vertical combustion passage, such passages being spaced along a wall of the combustion passage and including mixing means on said wall above the passages for mixing secondary air with combustion gases.

47. A stove as in claim 46 wherein said mixing means comprises a rib extending into the vertical combustion passage above each such secondary air passage.

48. A stove as in claim 27 wherein said combustion unit is formed from high temperature refractory material, said secondary combustion air flow system includes a secondary air distribution chamber formed in the secondary combustion unit above the mixing and secondary combustion chamber and including at least one opening in the secondary combustion unit communicating such chambers.

49. A stove as in claim 48 including a plurality of holes communicating such chambers, said holes being spaced along the length of said first combustion passage.

50. A stove as in claim 29 including a second outlet opening in the secondary combustion unit, said chamber also defining a second combustion passage extending from the combustion gas inlet opening to the second outlet opening and including an additional plurality of openings communicating the secondary air distribution chamber and said second passage.

51. A stove as in claim 50 wherein both said passages are U-shaped and said combustion gas inlet opening is located between said outlet openings.

52. A stove as in claim 26 including a grate in the firebox floor, wherein the primary combustion flow system includes an inlet port, a first discharge opening for flowing primary combustion air into the firebox, a bleed opening for flowing a small volume of primary combustion air under the grate at all times, a second discharge opening for flowing a large volume of primary combustion air under the grate and a valve located between the inlet port and said discharge openings, said valve having a wood burning position for flowing a large volume of primary combustion air through said first discharge opening and closing said second discharge opening and a coal-burning position for flowing a small volume of air through the first discharge opening and a large volume of air through the second discharge opening.

53. A stove as in claim 52 wherein said valve includes a valve member, a handle on the valve member extending outwardly of the stove, the front wall including a coal slot and a wood slot, said handle being selectively positioned in either of said slots whereby when the handle is positioned in the wood slot the valve member is in the wood burning position and when the handle is positioned in the coal slot the valve member is in the coal burning position.

54. A stove as in claim 53 including a lower door on the front wall of the firebox, said slots being formed in the door.

55. A stove as in claim 26 including a grate in the floor of the firebox, wherein said primary combustion air flow system includes a combustion air inlet port, an inlet chamber communicating with said port and extending therefrom to the front corners of the stove, first manifolds communicating with the chamber and extending upwardly therefrom at the front corners of the stove, a first cross manifold joining the upper ends of the first manifolds, a second cross manifold located above the first cross manifold, a mouth opening into the interior of the firebox, a third manifold communicating the second cross manifold to said mouth, a first opening in the first cross manifold communicating such manifold with the second cross manifold, a second opening in the first cross manifold communicating such manifold with the firebox adjacent the grate, and a valving member located within the first cross manifold and including a handle extending outwardly of the stove for shifting the valving member between a wood-burning position where the first opening is open and the second opening is closed and a second coal-burning position in which the first opening is partially closed and the second opening is open.

56. A stove as in claim 55 wherein part of the front wall overlies the first cross manifold, and including a pair of spaced slots formed in such part, said handle extending into one slot when the valving member is in the wood-burning position and extending into the other slot when the valving member is in the coal-burning position.

* * * * *